US006454279B1

(12) United States Patent
Yang

(10) Patent No.: US 6,454,279 B1
(45) Date of Patent: Sep. 24, 2002

(54) SKATE WITH FOLDABLE WHEELS

(76) Inventor: Lien-Chuan Yang, 11F-1, No. 149, Roosevelt Rd. Sec. 3, Taipei (TW)

( * ) Notice: Subject to any disclaimer, the term of this patent is extended or adjusted under 35 U.S.C. 154(b) by 0 days.

(21) Appl. No.: 09/842,815

(22) Filed: Apr. 27, 2001

(30) Foreign Application Priority Data

Apr. 6, 2001 (TW) ..... 90205344

(51) Int. Cl.[7] ..... A63C 17/04
(52) U.S. Cl. ..... 280/11.223; 280/11.27
(58) Field of Search ..... 280/7.12, 7.14, 280/11.19, 11.223, 11.224, 11.25, 11.27

(56) References Cited

U.S. PATENT DOCUMENTS 2,070,646 A * 1/1937 Blochinger ..... 280/11.208
3,306,623 A * 2/1967 Weitzner ..... 280/11.19
3,884,485 A * 5/1975 Walle ..... 280/841
4,314,707 A * 2/1982 Welch ..... 280/11.209
4,333,249 A * 6/1982 Schaefer ..... 280/11.19
5,527,049 A * 6/1996 Ortiz ..... 188/5
5,697,622 A * 12/1997 Warinner ..... 188/5
6,042,125 A * 3/2000 Wu ..... 280/11.208
6,120,039 A * 9/2000 Clementi ..... 280/11.19
6,270,095 B1 * 8/2001 Chang ..... 280/87.041

* cited by examiner

*Primary Examiner*—Jack Lavinder
*Assistant Examiner*—Xuan Lan Nguyen
(74) *Attorney, Agent, or Firm*—Dennison, Schultz & Dougherty

(57) ABSTRACT

A skate with foldable wheels, comprising a shoe body, a sole, a folding device and a plurality of wheels, the shoe body is for insertion therein a foot of a user, the sole is provided on the bottom of the shoe body, and is combined with the folding device, the wheels are provided beneath the sole; a pressing mechanism which can be pressed for operation at both lateral sides of the skate is provided to allow the folding device to be collapsed/stretched quickly and o allow the wheels to be stored in a plurality of recesses provided in the sole. The skate is structurally firm, and is convenient for operation.

8 Claims, 13 Drawing Sheets

SKATE WITH FOLDABLE WHEELS

BACKGROUND OF THE INVENTION

The present invention is related to a skate structure of which the wheels can be folded, and especially to a skate structure of which the sole and a folding device are combined with each other, and a pressing mechanism which can be pressed for operation at both lateral sides of the skate to make the wheels folded quickly and stored in a plurality of recesses provided in the sole.

The way of storing a pair of skates had been being always thought highly of since skates were widely used, and various skates convenient for storing have been developed.

In the recent years, the sole of a skate has been provided with recesses to store wheels therein when the wheels are collapsed by folding; however among them, some are inconvenient for operation, some are structurally weak, and most of them are not well designed, by virtue of this, the folding mechanisms for the wheels which are mostly made from metallic members may create danger when in use.

In view of this, the inventor of the present invention studied and developed a skate structure of which the wheels can be fast collapsed and stretched, and are structurally firm, convenient for operation.

SUMMARY OF THE INVENTION

The primary object of the present invention is to provide a skate with foldable wheels, and of which the sole is provided on the top surface thereof with a folding device, two elongate slots are formed on the sole, the wheels of the skate can be received in a plurality of recesses provided in the sole, in this way, the wheels can be collapsed and such structure is firm.

Another object of the present invent ion is to provide a skate with foldable wheels, when in use, it needs only to press two push buttons provided on the two lateral sides of the sole to fast open the folding device, such operation is simple and thereby the skate is convenient for use.

Another object of the present invention is to provide a skate with foldable wheels, wherein, the sole is provided by way of sticking and with an abrasion durable piece protruding from the front edge of the bottom of the sole, thereby, the skate can have a function of braking to increase safety in use.

In order to get the objects stated above, the present invention is provided with a shoe body, a sole, a folding device and a plurality of wheels combined with one another. Wherein, the shoe body is for insertion therein a foot of a user; the sole is provided on the bottom of the shoe body, and is combined with the folding device, the wheels are provided beneath the sole. The sole is made of thick material with a little elasticity, and has two elongate slots thereon to cooperate with the folding device, the sole is provided at the elongate slots with two recesses respectively. The folding device includes an elongate bottom plate, a folding mechanism and a pressing mechanism; the elongate bottom plate is provided on the top surface of the sole, members of the folding mechanism are extended through the two elongate slots to be hung at both lateral sides of the sole. The wheels are stretched out or collapsed to place in the recesses by means of links, fixing pieces, slide grooves, latching axles and springs. The folding mechanism and the pressing mechanism are combined with each other; by provision of the push buttons, the axles and springs on the two lateral sides, the folding mechanism is in a released stated when the push buttons on the two lateral sides are pressed, now the wheels can be collapsed by an external force into the recesses of the sole, or can be stretched out from the recesses by means of the springs automatically, operation of the skate is simple, the wheels can be fast collapsed, and safety and convenience of use of the skate are increased.

The present invention will be apparent in its structure and characteristics after reading the detailed description of the preferred embodiment thereof in reference to the accompanying drawings.

DETAILED DESCRIPTION OF THE PREFERRED EMBODIMENT

Figure 1:
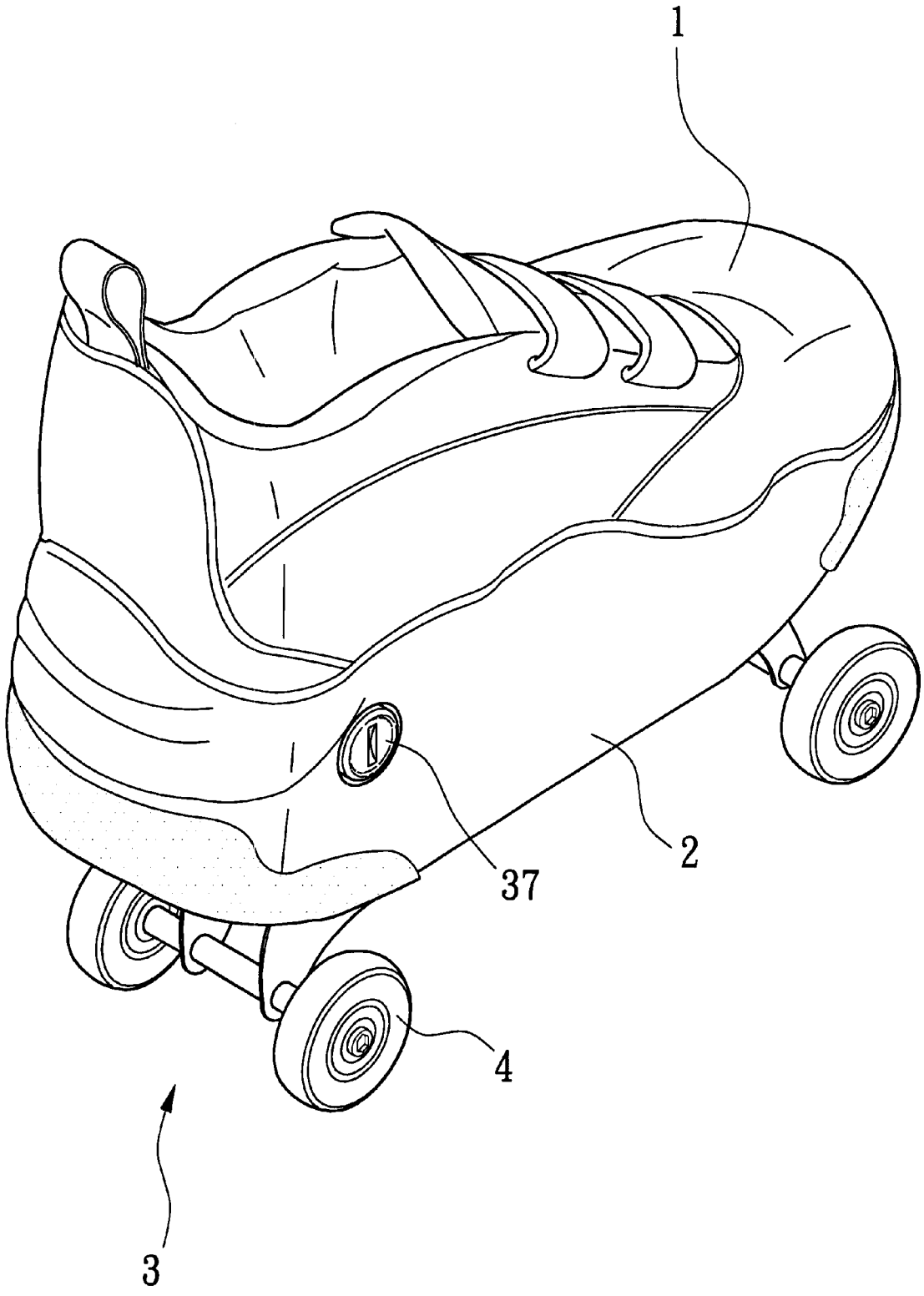
FIG. 1 is a perspective view of an embodiment of the present invention.

Referring firstly to FIGS. 1–5, the skate with foldable wheels of the present invention is comprised of a shoe body 1, a sole 2, a folding device 3 and a plurality of wheels 4.

Wherein, the shoe body 1 is for insertion therein a foot of a user; the sole 2 is provided on the bottom of the shoe body 1, and is combined with the folding device 3, the wheels 4 are provided beneath the sole 2.

The sole 2 is made of thick material such as foamed plastic with a little elasticity, and has two elongate slots 21 thereon, the sole 2 is provided inwardly from the two lateral sides with two recesses 22 respectively. The top surface of the sole 2 has a dented portion 24. The sole 2 is provided by way of sticking with an abrasion durable piece 23 protruding from the front edge of the bottom of the sole 2 itself, thereby, the skate can have a function of braking. The sole 2 is also provided with an abrasion durable piece 25 by sticking on the rear edge of the bottom thereof.

The folding device 3 includes an elongate bottom plate 31, a folding mechanism 30 and a pressing mechanism 370 combined with one another; the folding mechanism 30 is comprised of two front fixing pieces 32, two rear fixing pieces 33, two links 36 and at least a spring 39. The elongate bottom plate 31 is provided on the front end thereof with a protrusion 311, and is provided on the front and rear ends thereof with two front and rear hanging sheets 312 and 314 respectively. The front and rear hanging sheets 312 and 314 are provided respectively with dented portions 313, 315 which are further provided therein with holes, slide slots and positioning notches respectively in corresponding to those provided on the two reinforcement plates on the two lateral sides to be described hereinafter. The dented portions 313 of the two front hanging sheets 312 are provided each with a front reinforcement plate 34 which has a hole 341 and a slide slot 342 beneath the former. The dented portions 315 of the two rear hanging sheets 314 are provided each with a rear reinforcement plate 35 which has a positioning notch 353 and a slide slot 352 beneath the former; further beneath the latter, there is a hole 351. Two front fixing pieces 32 are provided outside of the two front reinforcement plates 34 respectively; the front fixing pieces 32 are provided each with holes 321, 322 and 323 serially from up downwards. And two rear fixing pieces 33 are provided outside of the two rear reinforcement plates 35 respectively; the rear fixing pieces 33 are provided each with a slide slot 331 and holes 333, 334 and 335 serially from up downwards. The slide slot 331 has on both ends thereof a positioning end 332 of a larger diameter. A bended link 36 is movably connected between each couple of the front and rear fixing pieces 32, 33 and is provided on both ends thereof with a hole 362 (361). At the right hand of the front ends, a corresponding latching axle 337 is extended through the hole 362, the positioning end 332 of one of the front fixing pieces 32, the slide slot 342 of a front reinforcement plate 34, a slide slot provided in the corresponding front hanging sheet 312 of the elongate bottom plate 31 and then through the identical member group at the other side or left hand. And a fixing latch 324 is extended serially through the holes 321 of the front fixing pieces 32, the holes 341 of a front reinforcement plate 34 and the hole on a corresponding front hanging sheet 312 of the elongate bottom plate 31, and then through a horizontal hollow pipe 325 and subsequently through the identical member group at the other side of the horizontal hollow pipe 325 and finally is movably positioned. The lower holes 323 of the front fixing pieces 32 are extended therethrough by an axial pipe 41 which is slipped into an inner sleeve 42 located between the two front fixing pieces 32; the axial pipe 41 is thereby extended through the two front fixing pieces 32 and into two external sleeves 43 and then is extended through two wheels 4 at both ends thereof, finally is screwed tight with screws 44.

The rear fixing pieces 33 are also extended therethrough by the axial pipe 41 to connect with the two wheels 4 at both sides, this will not be further described. A fixing latch 336 is extended serially through the hole 334 of a rear fixing piece 33, the hole 351 of one of the rear reinforcement plates 35 and the hole on one of the rear hanging sheets 314 of the elongate bottom plate 31. The fixing latch 336 is provided thereon between the two rear fixing pieces 33 with two springs 39 which each has an end connected to the corresponding latching axle 337, and has another end abutted against the elongate bottom plate 31. The fixing latch 336 then is extended serially through the identical member group at the other side. And another latching axle 337 is extended through the hole 361 of the link 36, the hole 333 of one of the rear fixing pieces 33, the slide slot 352 of a rear reinforcement plate 35, a slide slot provided in the corresponding rear hanging sheet 314 of the elongate bottom plate 31 and then through the identical member group at the other side.

Referring to FIGS. 4*a*–7*b*, the pressing mechanism 370 is provided on the two lateral sides of the sole with two push buttons 37 which each has an axle 371 provided on the front end thereof with a threaded portion 372 having a smaller diameter, the threaded portion 372 of the axle 371 is extended serially through an annular engaging block 373, a slide slot 331 of a rear fixing piece 33, the positioning notch 353 of a rear reinforcement plate 35 and a corresponding positioning notch provided in the rear hanging sheet 314 of the elongate bottom plate 31 to screw connect with a screw hole 382 in a block 38. The block 38 has on the top and bottom surfaces thereof respectively a plane area 381 which can be engaged tightly with the positioning notch 353 of a rear reinforcement plate 35 and the corresponding rear hanging sheet 314 of the elongate bottom plate 31. The block 38 has on the other end thereof a groove abutting against a spring 383, the other end of the spring 383 abuts against a partitioning section 316 of the elongate bottom plate 31; the other side of the pressing mechanism 370 is same as the aforesaid situation and no more description is needed.

With the above mentioned members, the skate with foldable wheels of the present invention is completed; the present invention is characterized by that: by providing the folding device 3 on the top of the sole 2, and by providing the two elongate slots 21 on the sole 2, the wheels 4 are collapsible to place in the recesses 22 of the sole 2 in the form of a normal sporting shoe. When the wheels 4 are collapsed (referring to FIGS. 7*a* and 7*b*), by pressing the push buttons 37, the latching axles 371 of the push buttons 37 push the annular engaging blocks 373 to force the latter to be released from the positioning end 332 of a slide slot 331 on the rear fixing pieces 33. At this time, the folding device 3 is opened by virtue that the diameter of each of the latching axles 371 of the push buttons 37 is smaller than the width of the slide slot 331 on the rear fixing pieces 33 and the diameter of the positioning end 332, and that there are the springs 39 provided on the fixing latch 336. When in stretching the folding device 3, the corresponding latching axle 337 is moved about the fixing latch 336 as it axis; the corresponding latching axle 337moves the link 36 and slides along the slide slot 352 of a rear reinforcement plate 35, along a corresponding slide slot provided in the rear hanging sheet 314 of the elongate bottom plate 31, meantime, the link 36 moves the latching axle 337 at the front end to slide along the slide slot 342 of a front reinforcement plate 34, along the slide slot provided in the corresponding front hanging sheet 312 of the elongate bottom plate 31, and to move the two front fixing pieces 32. The skate thereby can be used for skating and is structurally firm; the sole 2 is provided by way of sticking with an abrasion durable piece 23 protruding from the front edge of the bottom of the sole 2 itself, thereby, the skate can have a function of braking. The present invention thereby is firmly combined and easy for collapsing; its cost of production is low, and its practicality and safety are increased.

Figure 8:
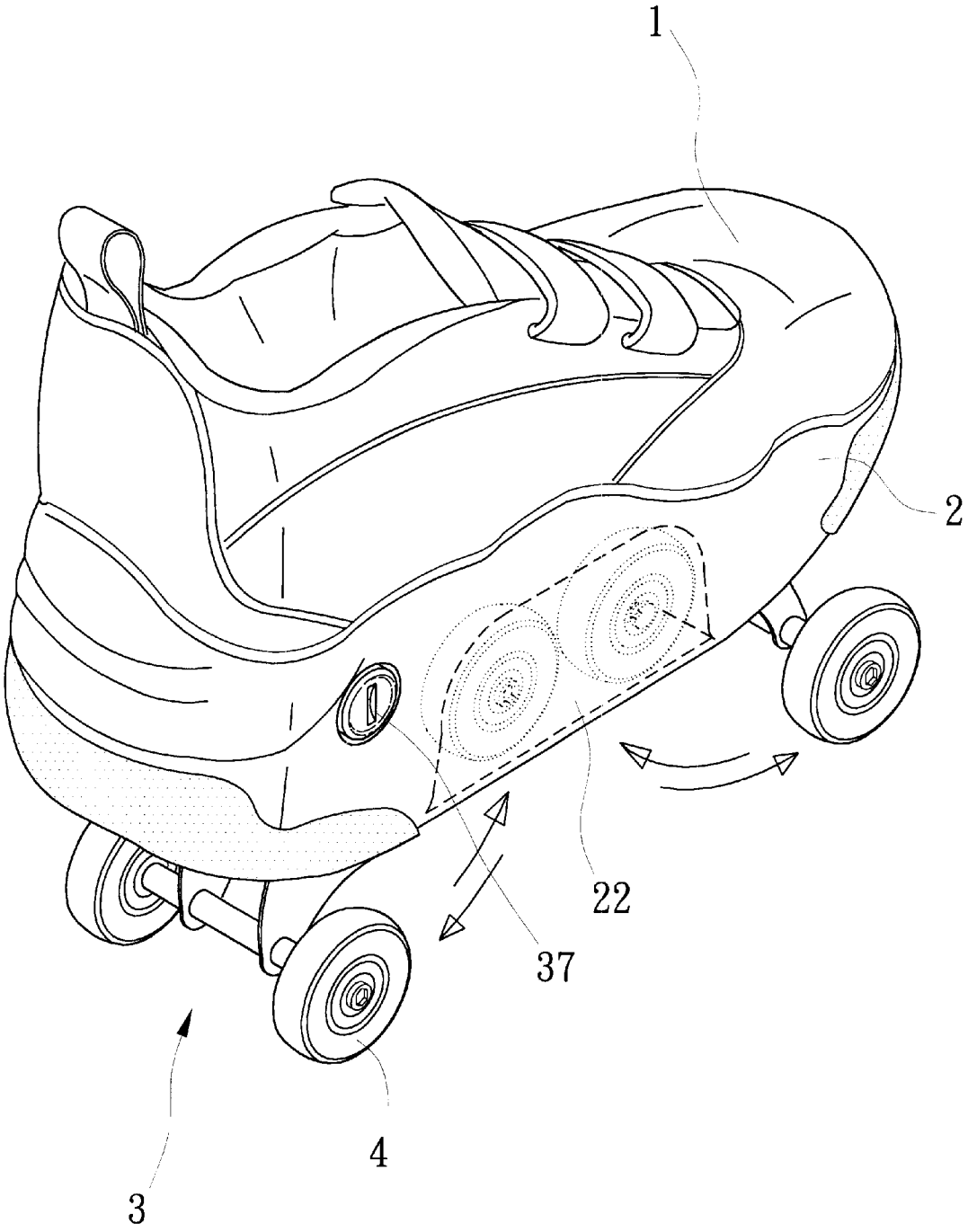
FIG. 8 is a perspective view showing the appearance of the embodiment of the present invention in use.
Figure 9:
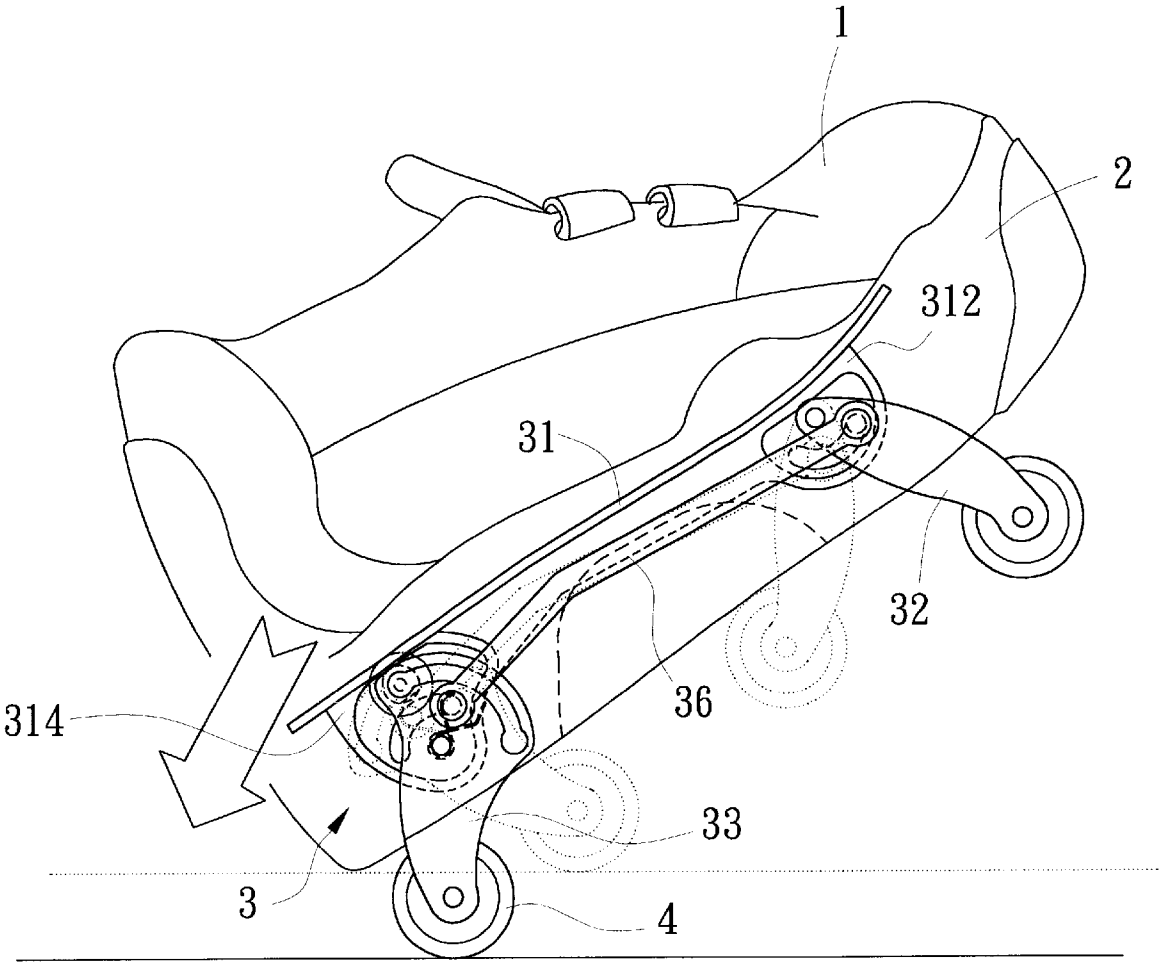
FIG. 9 is a sectional schematic view showing the folding device of the present invention in use.
Figure 10:
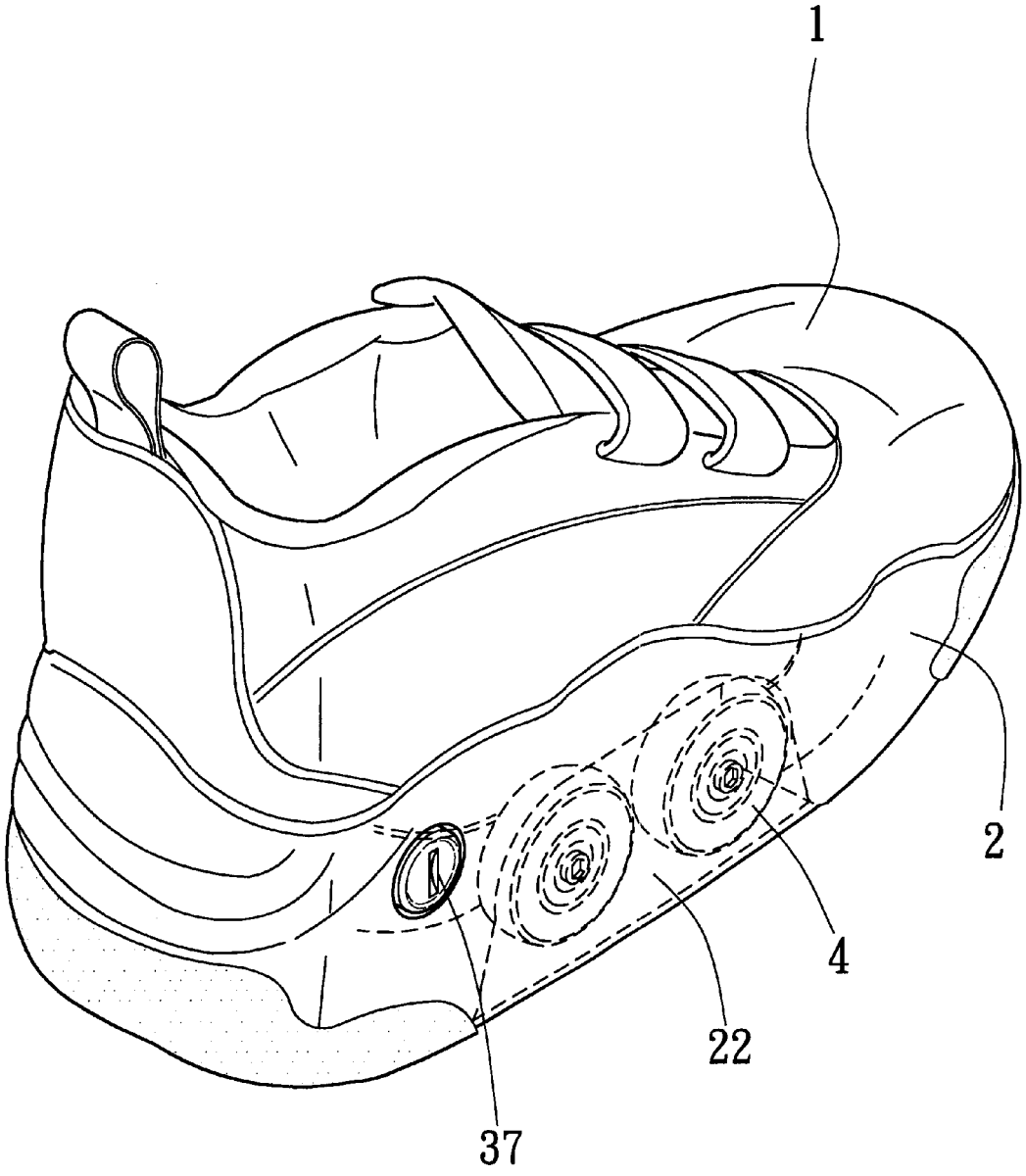
FIG. 10 is a perspective view showing the appearance of another embodiment of the present invention in use.

Referring to FIGS. 8–10, when it is to release the wheels for using the skate, the push buttons 37 are pressed; by virtue that there are the springs 39 provided on the fixing latch 336, when in stretching the folding device 3, the corresponding latching axle 337 is moved about the fixing latch 336 as it axis; the corresponding latching axle 337 moves the link 36 and moves the two front fixing pieces 32. The skate thereby can be used for skating. The sole 2 is provided byway of sticking with an abrasion durable piece 23 protruding from the front edge of the bottom of the sole 2 itself; thereby, the skate can have a function of braking. When it is to collapse the skate, it needs only to lift the shoe body to abut the rear wheels 4 on the ground, then to press the push buttons 37 together with a pressing down force, the folding device 3 can thus be activated to store the wheels 4 in the recesses 22 at the two lateral sides of the sole 2 respectively; the wheels 4 thus are collapsed and hidden in the sole 2. The collapsible skate of the present invention thereby is firmly combined and easy for collapsing; its cost of production is low, and its practicality and safety are increased.

Figure 2A:
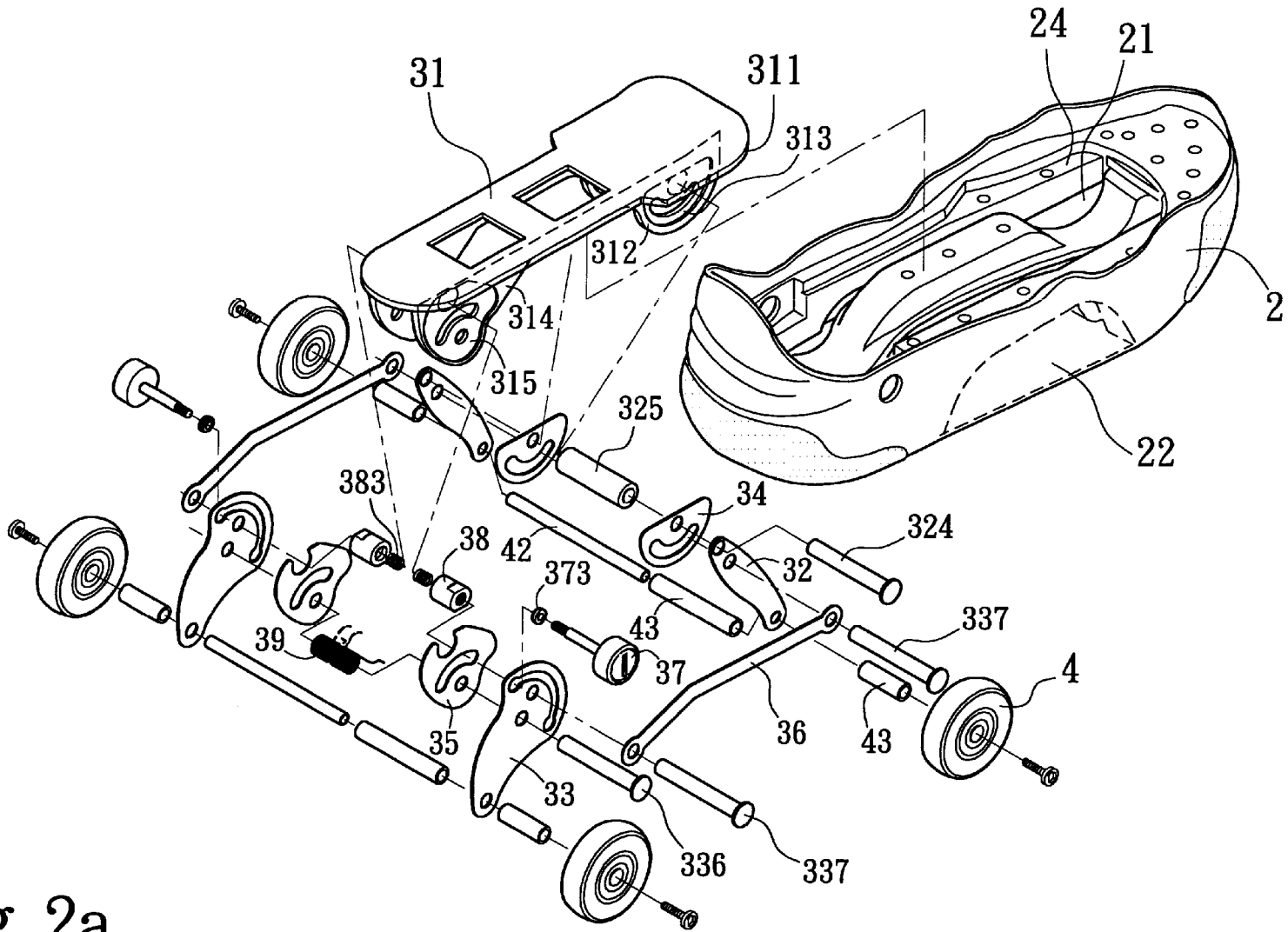
FIG. 2*a* is an analytical perspective view of an embodiment of a folding device of the present invention.
Figure 2B:
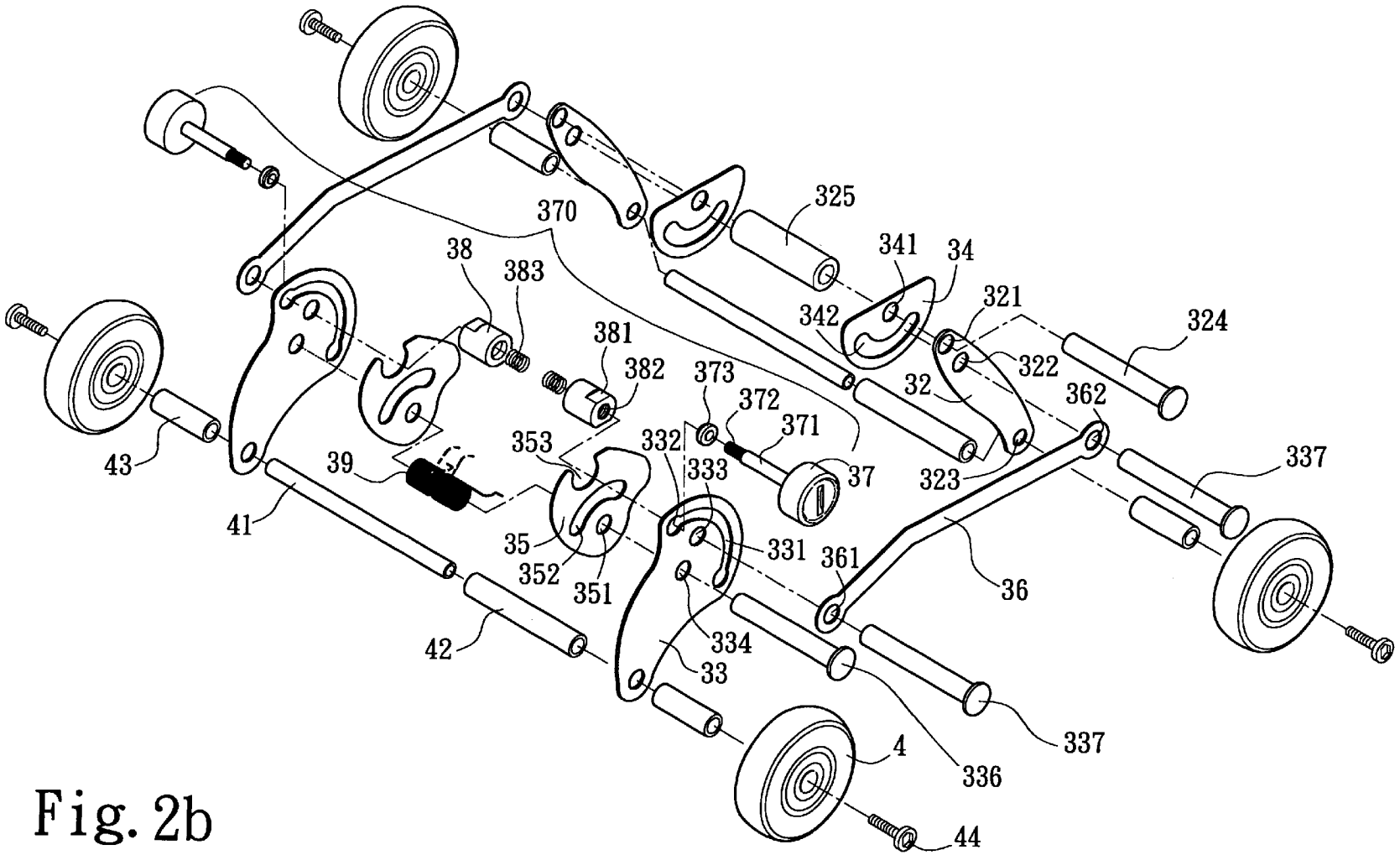
FIG. 2*b* is an analytical perspective view of partial parts of the embodiment of the folding device of the present invention.
Figure 3:
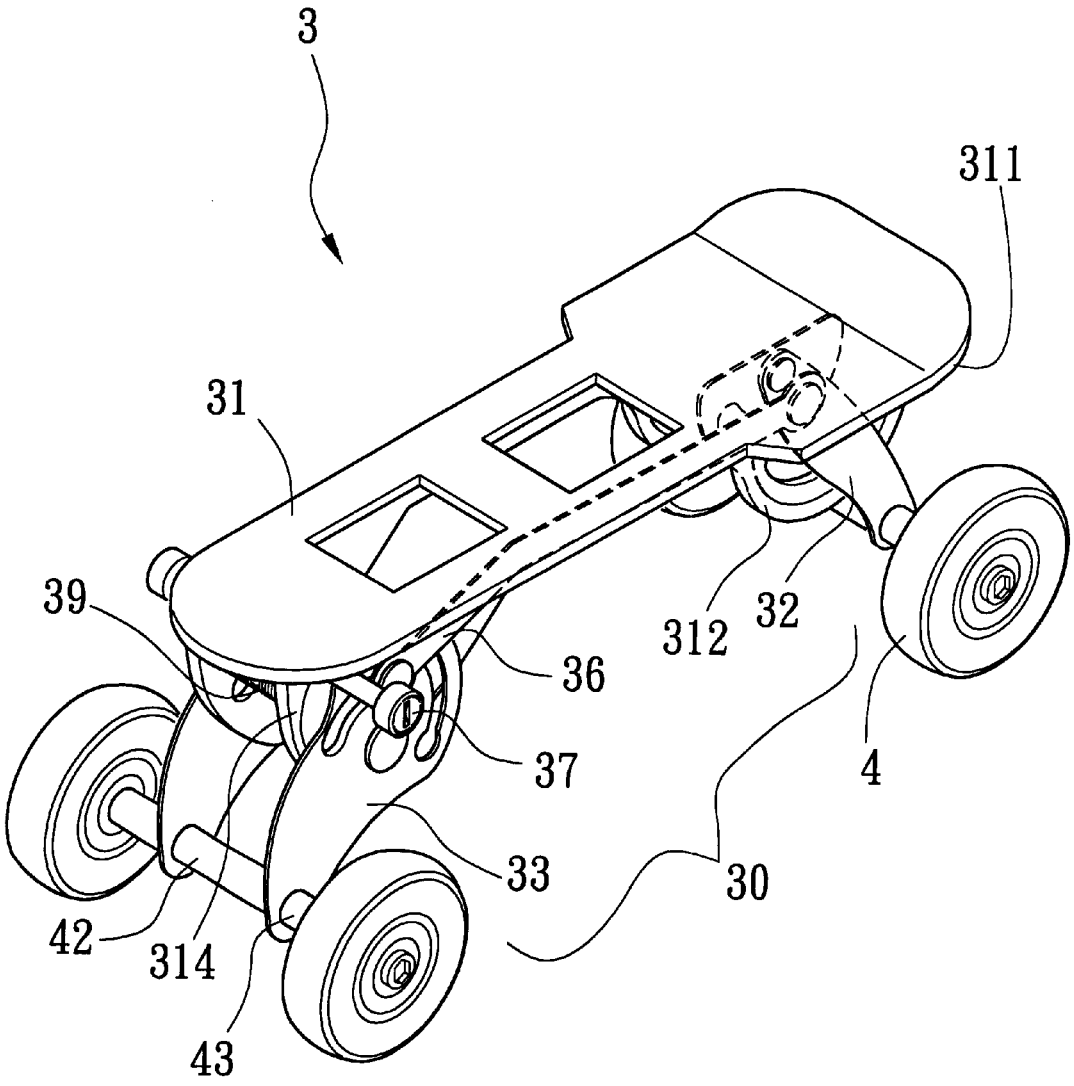
FIG. 3 is a perspective view showing the appearance of the embodiment of the folding device of the present invention.
Figure 4A:
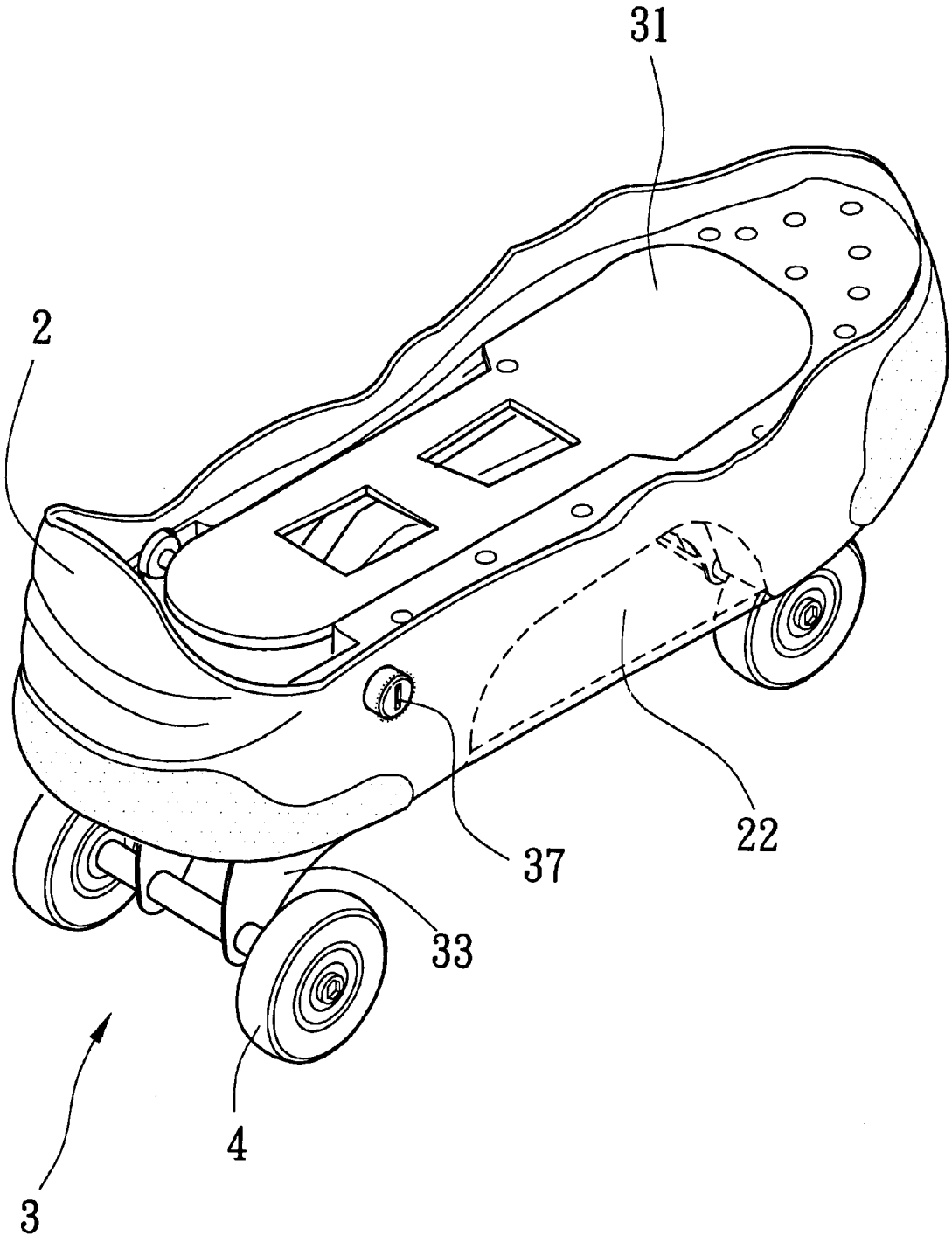
FIG. 4*a* is a perspective view showing the appearance of the folding device of the present invention in combination with the sole.
Figure 4B:
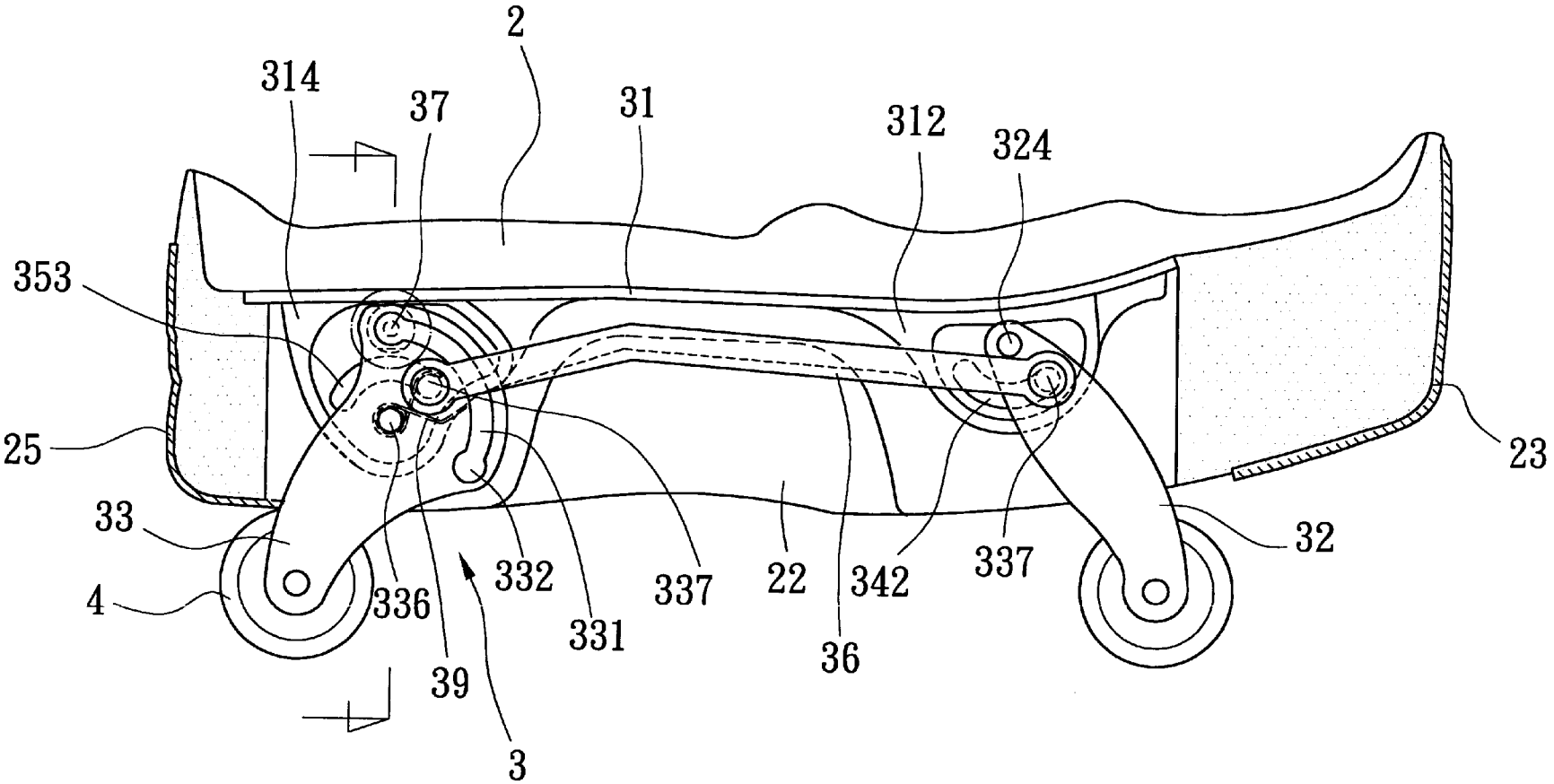
FIG. 4*b* is a sectional schematic view showing the folding device of the present invention in combination with the sole.
Figure 5:
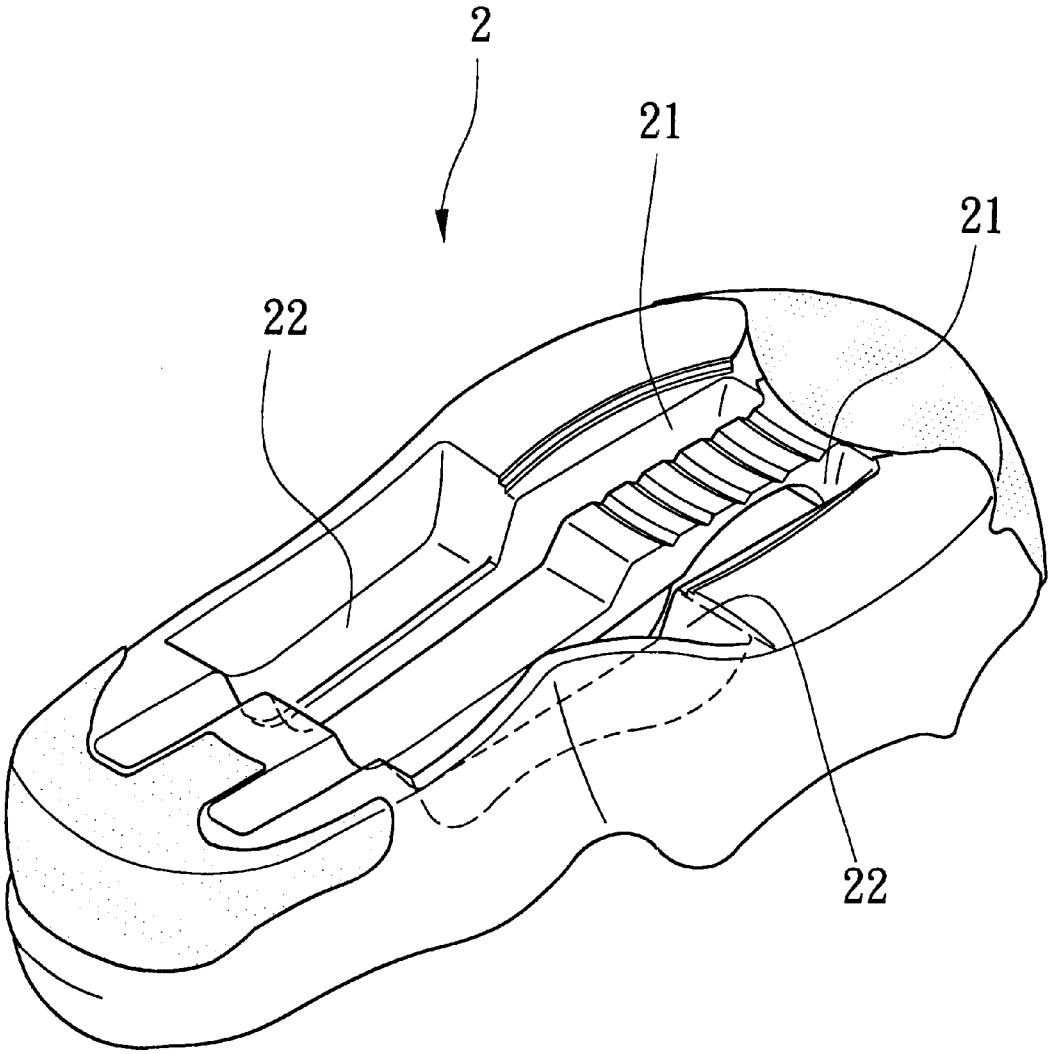
FIG. 5 is a perspective view showing the bottom of the sole of the present invention.
Figure 6A:
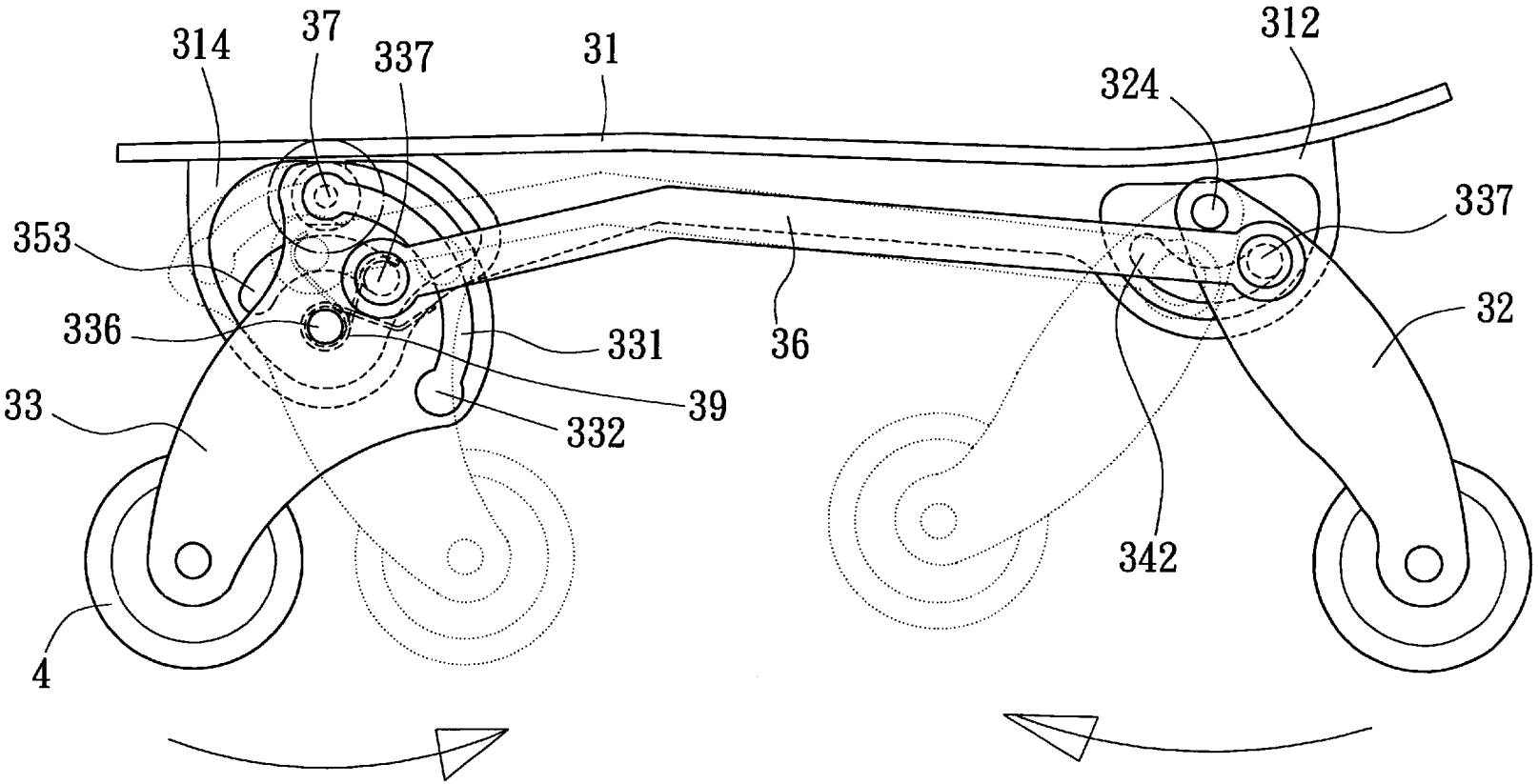
FIGS. 6*a* and 6*b* are schematic views showing stretching and collapsing of the wheels of the present invention.
Figure 6B:
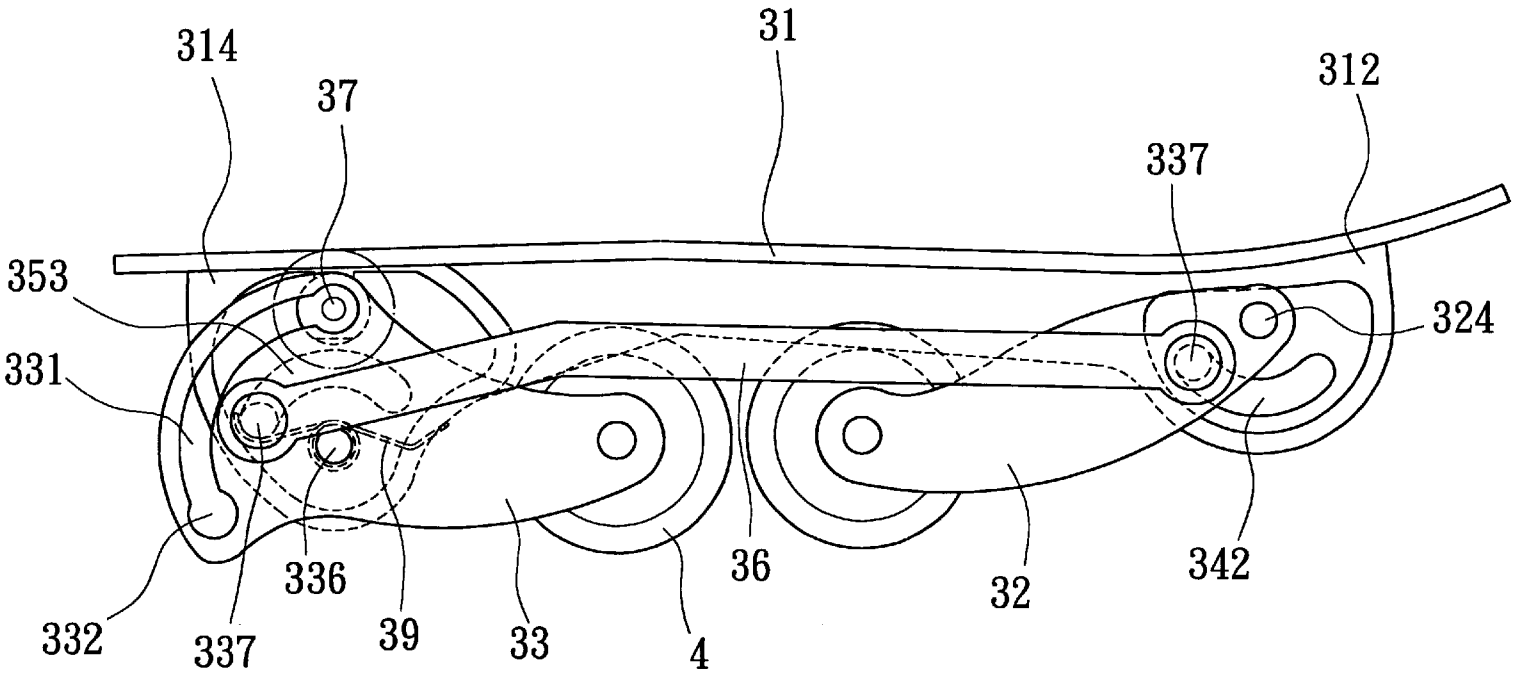
Figure 7A:
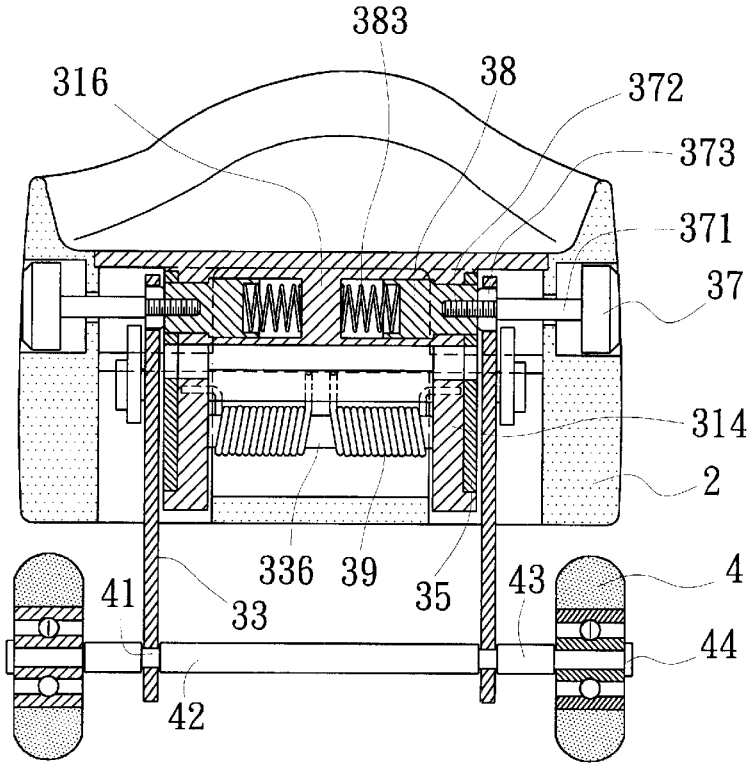
FIGS. 7*a* and 7*b* are sectional schematic views showing the engaging mechanism of the present invention.
Figure 7B:
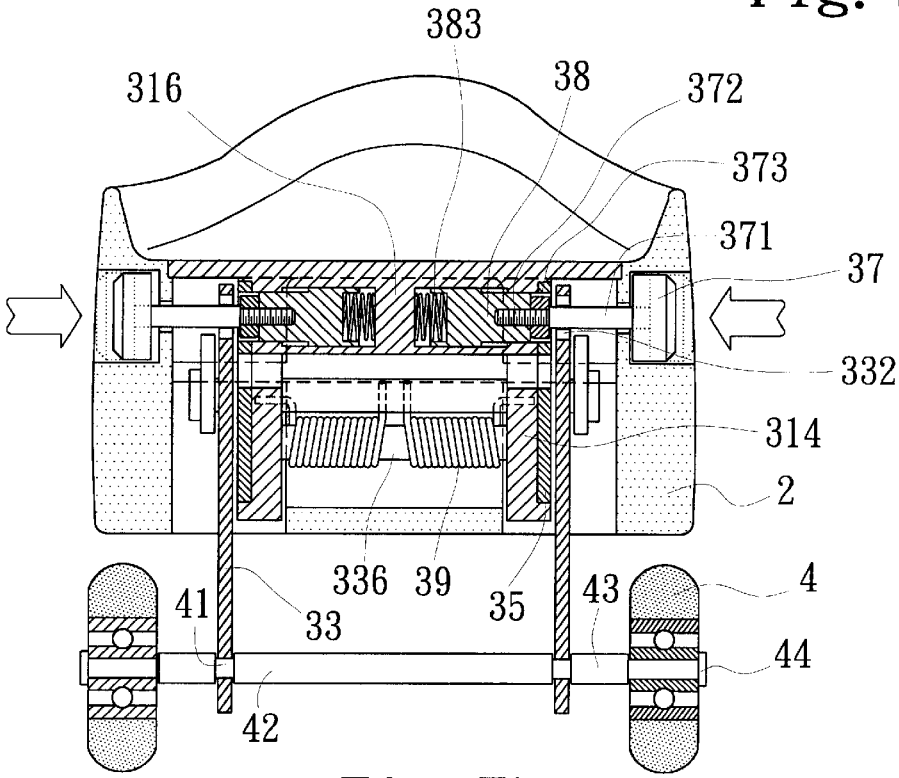

As to the provision of the front and rear reinforcement plates as shown by the embodiment depicted in FIGS. 2*a* and 2*b,* wherein, the front and rear reinforcement plates are provided in the front and rear dented portions provided respectively on the front and rear hanging sheets for convenient storing of the wheels and to strengthen the structure of the skate. However, the front and rear reinforcement plates can be omitted so long that there are no front or rear dented portions provided respectively on the front or rear hanging sheets, and the wheels can

What is claimed is:

1. A skate with foldable wheels, comprising a shoe body, a sole, a folding device and a plurality of wheels, said shoe body is for insertion therein a foot of a user, said sole is provided on the bottom of the shoe body, and is combined with said folding device, said wheels are provided beneath said sole; said skate is characterized by that:

said sole is made of thick material with a little elasticity, and has two elongate slots thereon, said sole is provided inwardly from the two lateral sides thereof with two recesses respectively;

said folding device includes an elongate bottom plate, a folding mechanism and a pressing mechanism; said elongate bottom plate is provided on the top of said sole, members of said folding mechanism are extended through said two elongate slots to be hung at both lateral sides of said sole, said wheels are collapsed to place in said recesses by means of links, fixing pieces, slide grooves, latching axles and springs, said folding mechanism and said pressing mechanism are combined with each other; by provision of push buttons, axles and springs on said two lateral sides, said folding mechanism is in a released state when said push buttons on said two lateral sides are pressed, now said wheels are collapsed by an external force into said recesses of said sole and are stretched out from said recessed by means of said springs automatically and wherein, said elongate bottom plate of said folding device is provided on the front end thereof with a protrusion, and is provided on the front and rear ends thereof with two front and rear hanging sheets respectively; said front hanging sheets are provided each with a hole and a slide slot beneath said hole; said rear hanging sheets are provided each with a positioning notch and a slide slot beneath said positioning notch, further there is a hole beneath said slide slot; said fixing pieces include two front and two rear fixing pieces, said two front fixing pieces are provided outside of said front hanging sheets respectively, said front fixing pieces are provided each with three holes serially from up downwards; and said two rear fixing pieces are provided outside of said rear hanging sheets respectively which are provided each with a slide slot and three holes serially from up downwards, said slide slot has on both ends thereof a positioning end of a larger diameter; one of said links is movably connected between said front and rear fixing pieces and is provided on both ends thereof with a hole extended therethrough by a latching axle each; said front and rear fixing pieces are further extended therethrough each by a fixing latch as an axis, said springs are respectively provided on said fixing latches and two blocks all between said rear fixing pieces, number of said springs provided on said fixing latches is at least one which each has an end connected to a corresponding one of said latching axles, and has another end abutted against said elongate bottom plate; said pressing mechanism is provided on said two lateral sides of said sole with two push buttons which each has an axle provided on the front end thereof with a threaded portion having a smaller diameter, said threaded portion of said axle is extended serially through an annular engaging block, a slide slot of one of said rear fixing pieces and a positioning notch provided in one of said rear hanging sheets of said elongate bottom plate to connect with one of said blocks; said block has one end thereof abutted against a spring, the other end of said spring abuts against said elongate bottom plate; with such arrangement, collapsing and stretching of said wheels are convenient and simple.

2. A skate with foldable wheels as in claim 1, wherein said front and rear hanging sheets are provided each with a dented portion, said dented portions of said front hanging sheets each has a reinforcement plate provided with a hole and a slide slot beneath said hole; said dented portions of said rear hanging sheets are provided each with a rear reinforcement plate which has a positioning notch and a slide slot beneath said positioning notch, and further beneath said slide slot, there is a hole; said skate thus is strengthened.

3. A skate with foldable wheels as in claim 1, wherein, said push buttons which each has said axle and provided each on the front end thereof with said threaded portion are tightly engaged with a screw hole of said block.

4. A skate with foldable wheels as in claim 1, wherein, said block has on the top and bottom surfaces thereof respectively a plane area which is adapted to engaging tightly with said positioning notch of a corresponding one of said rear hanging sheet of said elongate bottom plate for firm fixing.

5. A skate with foldable wheels as in claim 1, wherein, said block has on the other end thereof a groove for abutting against said spring of said block, and said elongate bottom plate has a partitioning section to be abutted against by the other end of said spring.

6. A skate with foldable wheels as in claim 1, wherein, the top surface of said sole has a dented portion for mounting said elongate bottom plate of said folding device.

7. A skate with foldable wheels as in claim 1, wherein, said sole is provided by way of sticking with an abrasion durable piece protruding from the front edge of the bottom of said sole itself, thereby, said skate has a function of braking; said sole is also provided with an abrasion durable piece by sticking on the rear edge of the bottom thereof.

8. A skate with foldable wheels as in claim 1, wherein, said link is bended in favor of collapsing and stretching of said wheels.

* * * * *